US011377947B2

(12) United States Patent
Mujica et al.

(10) Patent No.: US 11,377,947 B2
(45) Date of Patent: Jul. 5, 2022

(54) SAFETY VARIABLE FREQUENCY DRIVE FOR PREVENTING OVER PRESSURIZATION OF A PIPING NETWORK

(71) Applicant: Saudi Arabian Oil Company, Dhahran (SA)

(72) Inventors: Pedro Alejandro Mujica, Dammam (SA); Herman Roberto Cipriano, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 371 days.

(21) Appl. No.: 16/654,781

(22) Filed: Oct. 16, 2019

(65) Prior Publication Data

US 2021/0115782 A1 Apr. 22, 2021

(51) Int. Cl.
*E21B 47/008* (2012.01)
*E21B 43/12* (2006.01)
(Continued)

(52) U.S. Cl.
CPC ..... *E21B 47/008* (2020.05); *E21B 43/128* (2013.01); *E21B 47/06* (2013.01); *F04B 19/04* (2013.01); *F04B 49/08* (2013.01)

(58) Field of Classification Search
CPC ..... E21B 47/008; E21B 43/128; E21B 47/06; E21B 43/00; F04B 19/04; F04B 49/08;
(Continued)

(56) References Cited

U.S. PATENT DOCUMENTS 5,422,808 A 6/1995 Catanese, Jr. et al.
10,677,032 B1 * 6/2020 Norton ..... E21B 47/008
(Continued)

FOREIGN PATENT DOCUMENTS

EP 0833436 8/2008
RU 2426867 8/2011

OTHER PUBLICATIONS

PCT International Search Report and Written Opinion in International Appln. No. PCT/US2020/055529, dated Feb. 1, 2021, 21 pages.

(Continued)

*Primary Examiner* — Brad Harcourt
(74) *Attorney, Agent, or Firm* — Fish & Richardson P.C.

(57) ABSTRACT

A method of preventing over-pressurization of a downstream piping network, using a safety VFD, includes continuously receiving, from sensors attached to an ESP, values representing input/output operating parameters of the ESP. The ESP is disposed in a wellbore and fluidically coupled to a piping network disposed at a surface of the wellbore. The method also includes comparing one or more values to operating parameter thresholds determined based on at least one of 1) expected ESP parameters during a blocked outlet condition of the piping network or 2) an association of the operating parameter threshold with a fluidic pressure of the piping network that has a potential of reaching an MAOP of the piping network. The method also includes determining that values meet the threshold and changing an input parameter of the ESP to change a fluidic output of the ESP to prevent the over pressurization of the downstream piping network.

17 Claims, 5 Drawing Sheets

(51) Int. Cl.

| | |
|---|---|
| ***E21B 47/06*** | (2012.01) |
| ***F04B 19/04*** | (2006.01) |
| ***F04B 49/08*** | (2006.01) |

(58) Field of Classification Search
CPC .. F04B 47/06; F04D 15/0066; F04D 15/0245; F04D 13/10; F04D 15/0088; F05D 2260/80
See application file for complete search history.

(56) References Cited

U.S. PATENT DOCUMENTS

2005/0217350 A1* 10/2005 Jabusch ..... E21B 47/047 73/64.55
2011/0251728 A1 10/2011 Batho et al.
2013/0151156 A1* 6/2013 Noui-Mehidi ..... G01V 3/06 702/7
2016/0118919 A1* 4/2016 Malone ..... H02P 29/028 318/400.42
2017/0328827 A1* 11/2017 Mujica ..... G01N 17/00
2018/0298738 A1 10/2018 Mujica et al.
2019/0294183 A1 9/2019 Al Khunaizi et al.

OTHER PUBLICATIONS

Flatem, "Electrical Submersible Pumps," Oilfield Review, Dec. 2015, 2 pages.
Al-Dossary et al, "Effective Utilization of Variable Speed Drive with Electrical Submersible Pump's Boost Oil Production in a Remote Desert Field: Case Study," SPE-142597-MS, SPE Middle East Oil and Gas Show and Conference, Sep. 25-28, 2011, Manama, Bahrain, 8 pages.
Nelson-Bridgewater et al, "High Integrity Protection System for ESP Activated Wells," SPE-168347-MS, SPE International Conference on Health, Safety, and Environment, Mar. 17-19, 2014, Long Beach, California, USA, 10 pages.
Wilson et al, "Electrical Submersible Pump Performance Using Variable Speed Drive," SPE-13805-MS, SPE Production Operations Symposium, Mar. 10-12, 1985, Oklahoma City, Oklahoma, 8 pages.

* cited by examiner

SAFETY VARIABLE FREQUENCY DRIVE FOR PREVENTING OVER PRESSURIZATION OF A PIPING NETWORK

FIELD OF THE DISCLOSURE

This disclosure relates to controlling fluidic pressure for the safety of downstream piping systems.

BACKGROUND OF THE DISCLOSURE

An electrical submersible pump (ESP) disposed in a wellbore can transfer the necessary energy to a fluid in order to over pressurize an under-rated downstream piping network or system when a block condition occurs in a downstream location of the piping network. A block condition or shut-in condition can be present when a portion or an outlet of the piping network is blocked, preventing fluid from flowing along or leaving the piping network. If the ESP continues to pump fluid under a shut-in condition and a maximum dead head pressure of the ESP (at the corresponding frequency) is higher than a downstream maximum allowable operating pressure (MAOP) of the piping network, over pressurization of the piping network can occur, often resulting in loss of containment through rupture of a line or vessel of the under-rated piping network. Loss of containment can lead to fire and explosion with undesirable consequences to the safety of people, environment and financial losses.

SUMMARY

Implementations of the present disclosure include a method that includes continuously receiving, from a plurality of sensors attached to an electric submersible pump (ESP) and by a processor, a plurality of values representing output operating parameters of the ESP collected over time. The ESP is disposed in a wellbore and fluidically coupled to a piping network disposed at a surface of the wellbore, the piping network configured to flow fluid received from the ESP. The method also includes comparing, by the processor, one or more of the plurality of values to a respective plurality of operating parameter thresholds, each of the plurality of operating parameter thresholds determined based on at least one of 1) an expected ESP parameter during a blocked outlet condition of the piping network or 2) an association of the operating parameter threshold with a fluidic pressure of the piping network that has a potential of reaching a maximum allowable operating pressure (MAOP) of the piping network. The method also includes determining, by the processor and based on a result of comparing the one or more of the plurality of values to the plurality of operating parameter thresholds, that one or more values of the plurality of values meets or exceeds one or more threshold of the plurality of operating parameter thresholds, and based on the determination, changing, by the processor, at least one input parameter of the ESP to change a fluidic output of the ESP to prevent the over pressurization of the piping network.

In some implementations, the method further includes, prior to comparing the one or more of the plurality of values to the plurality of operating parameter thresholds, determining, by the processor, a first value representing a rate of change over time of an output operating parameter of the output operating parameters of the ESP. The at least one of the plurality of operating parameter thresholds includes a rate of change threshold representing a rate of change over time of the respective operating parameter that is indicative of a pressure with a potential to exceed the MAOP of the piping network, and where comparing the one or more of the plurality of values to the plurality of operating parameter thresholds includes comparing the first value to the rate of change threshold.

In some implementations, the processor includes a safety logic controller communicatively coupled to a variable frequency drive (VFD) controller. Comparing the one or more of the plurality of values to the plurality of operating parameter thresholds includes comparing the one or more of the plurality of values to the plurality of operating parameter thresholds by the safety logic controller and where changing the at least one input parameter of the ESP includes lowering an ESP operating frequency or cutting current of the ESP by the VFD controller.

In some implementations, the method further includes, prior to comparing the one or more of the plurality of values to the plurality of operating parameter thresholds, determining, by the processor using a MooN voting architecture and based on a hardware fault tolerance (HTF) equal to or greater than 0 and with a safety integrity level of between 1 and 3 (SIL 1-SIL 3), a number of values from the plurality of values to be compared to the plurality of operating parameter thresholds. Comparing the one or more of the plurality of values to the plurality of operating parameter thresholds includes comparing the number of values from the plurality of values to the plurality of operating parameter thresholds.

In some implementations, determining that the one or more values meets or exceeds the one or more thresholds includes using a MooN voting architecture with an HFT determined for a safety integrity level of between 1 and 3 (SIL 1-SIL 3).

In some implementations, the plurality of values includes one or more of a temperature of the ESP motor, revolutions per minute (RPM) of the ESP, horse power (HP) of the ESP, a current of the ESP, and a flow rate output of the ESP, where comparing the plurality of values include comparing each of the one or more of the plurality of values to a respective operating parameter threshold of the operating parameter thresholds. The operating parameter thresholds include a rate of change of a temperature of the ESP expected during the blocked outlet condition, revolutions per minute of the ESP required to produce a pressure equivalent to the MAOP, a rate of change of the HP of the ESP expected during the blocked outlet condition, a rate of change of current of the ESP expected during the blocked outlet condition, and an expected rate of change of flow rate output from the ESP during a blocked outlet condition. Determining that the one or more values meets or exceeds the one or more thresholds includes determining that at least one of the plurality of values is equal to or exceeds a respective operating parameter threshold.

In some implementations, continuously receiving the plurality of values includes receiving the plurality of values measured in real-time.

In some implementations, changing the at least one input parameter of the ESP includes reducing at least one of an input operating frequency of the ESP and an input current of the ESP based on predetermined voting criteria.

In some implementations, the method further includes receiving, by the processor, a pressure value from a pressure sensor disposed at a surface pipe of the piping network, the pressure value representing a fluidic pressure of the surface pipe or the piping network. The method can also include comparing, by the processor, the pressure value to the actual MAOP of the piping network. Determining that the one or more values meets or exceeds the one or more thresholds includes determining, based on the result of comparing the pressure value to the actual MAOP of the piping network and based on the result of comparing the one or more of the plurality of values to the plurality of operating parameter thresholds, a risk of over pressurization of the piping network.

In some implementations, the piping network includes equipment that includes at least one of a topside piping in offshore applications, surface piping in onshore applications, a trunkline, a flowline, a subsea flowline in offshore applications, or process equipment, and where the MAOP is the MAOP of a weakest element of the respective equipment or the weakest mechanical link of the piping network.

Implementations of the present disclosure feature an over-pressurization prevention system that includes a processor and a non-transitory computer-readable medium communicatively coupled to the processor, the medium storing instruction which, when executed, cause the processor to perform operations including continuously receiving, from a plurality of sensors attached to an electric submersible pump (ESP), a plurality of values representing output operating parameters of the ESP collected over time, the ESP disposed in a wellbore and fluidically coupled to a piping network disposed at a surface of the wellbore, the piping network configured to flow fluid received from the ESP. The operation also include comparing one or more of the plurality of values to a respective plurality of operating parameter thresholds, each of the plurality of operating parameter thresholds determined based on at least one of 1) an expected ESP parameter during a blocked outlet condition of the piping network or 2) an association of the operating parameter threshold with a fluidic pressure of the piping network that has a potential of reaching a maximum allowable operating pressure (MAOP) of the piping network. The operations also include determining, based on a result of comparing the one or more of the plurality of values to the plurality of operating parameter thresholds, that one or more values of the plurality of values meets or exceeds one or more threshold of the plurality of operating parameter thresholds, and based on the determination, changing at least one input parameter of the ESP to change a fluidic output of the ESP to prevent the over pressurization of the piping network.

In some implementations, the operations further include, prior to comparing the one or more of the plurality of values to the plurality of operating parameter thresholds, determining a first value representing a rate of change over time of an output operating parameter of the output operating parameters of the ESP, where at least one of the plurality of operating parameter thresholds includes a rate of change threshold representing a rate of change over time of the respective operating parameter that is indicative of a pressure with a potential to exceed the MAOP of the piping network, and where comparing the one or more of the plurality of values to the plurality of operating parameter thresholds includes comparing the first value to the rate of change threshold.

In some implementations, the processor includes a safety logic controller communicatively coupled to a variable frequency drive (VFD) controller. Comparing the one or more of the plurality of values to the plurality of operating parameter thresholds includes comparing the one or more of the plurality of values to the plurality of operating parameter thresholds by the safety logic controller and where changing the at least one input parameter of the ESP includes lowering a ESP operating frequency or cutting current of the ESP by the VFD controller.

In some implementations, the operations further include, prior to comparing the one or more of the plurality of values to the plurality of operating parameter thresholds, determining, using a MooN voting architecture and based on a hardware fault tolerance (HTF) determined for a safety integrity level of between 1 and 3 (SIL 1-SIL 3), a number of values from the plurality of values to be compared to the plurality of operating parameter thresholds. Comparing the one or more of the plurality of values to the plurality of operating parameter thresholds includes determining the number of values from the plurality of values to the plurality of operating parameter thresholds.

In some implementations, determining the first value includes using a 1 oo2 voting architecture with an HFT determined for a safety integrity level of between 1 and 3 (SIL 1-SIL 3).

In some implementations, the plurality of values includes one or more of a temperature of the ESP motor, revolutions per minute (RPM) of the ESP, horse power (HP) of the ESP, a current of the ESP, and a flow rate output of the ESP, where comparing the plurality of values include comparing each of the one or more of the plurality of values to a respective operating parameter threshold of the operating parameter thresholds. The operating parameter thresholds include a rate of change of a temperature of the ESP expected during the blocked outlet condition, revolutions per minute of the ESP required to produce a pressure equivalent to the MAOP, a rate of change of the HP of the ESP expected during the blocked outlet condition, a rate of change of current of the ESP expected during the blocked outlet condition, and an expected rate of change of flow rate output from the ESP during a blocked outlet condition, and where determining that the one or more values meets or exceeds the one or more thresholds includes determining, based on a predefined voting architecture, that at least one of the plurality of values is equal to or exceeds a respective operating parameter threshold.

In some implementations, the processor includes one or more of 1) a VFD controller with built-in safety logic solver hardware, 2) a processor communicatively coupled to a VFD controller, 3) a processor communicatively coupled to a safety logic controller, or 4) a processor communicatively coupled to a VFD controller and a safety logic controller.

In some implementations, controlling the at least one input parameter of the ESP includes reducing at least one of an input operating frequency of the ESP and an input current of the ESP based on predetermined voting criteria.

In some implementations, the operations further include: receiving a pressure value from a pressure sensor disposed at a surface pipe of the piping network, the pressure value representing a fluidic pressure of the surface pipe or the piping network, and comparing the pressure value to the actual MAOP of the piping network. Determining that the one or more values meets or exceeds the one or more thresholds includes determining, based on the result of comparing the pressure value to the actual MAOP of the piping network and based on the result of comparing the one or more of the plurality of values to the plurality of operating parameter thresholds, a risk of over pressurization of the piping network.

Implementations of the present disclosure also include a method that includes continuously receiving, by a processor, from at least one of 1) a plurality of sensors attached to an electric submersible pump (ESP) and 2) a pressure sensor at a piping network fluidically coupled to and configured to flow fluid from the ESP, at least one of 1) a respective plurality of values from the plurality of sensors, the plurality of values representing output operating parameters of the ESP, and 2) a pressure value from the pressure sensor representing a fluidic pressure of fluid flown from the ESP through the piping network. The method also include comparing, by the processor, at least one value of 1) the plurality of values and 2) the pressure value, to at least one of 1) a pressure limit threshold representing a maximum allowable pressure of the piping network and 2) an ESP operating parameter threshold determined based on the maximum allowable pressure of the piping network. The method also includes determining, by the processor and based on a result of comparing the at least one value to the at least one of the pressure limit threshold and the ESP operating parameter threshold, that one or more values of the at least one value meets or exceeds one or more of the at least one of the pressure limit threshold and the ESP operating parameter threshold, and based on the determination, changing, by the processor, at least one input parameter of the ESP to change a fluidic output of the ESP to prevent the over pressurization of the piping network.

DETAILED DESCRIPTION OF THE DISCLOSURE

Figure 1:
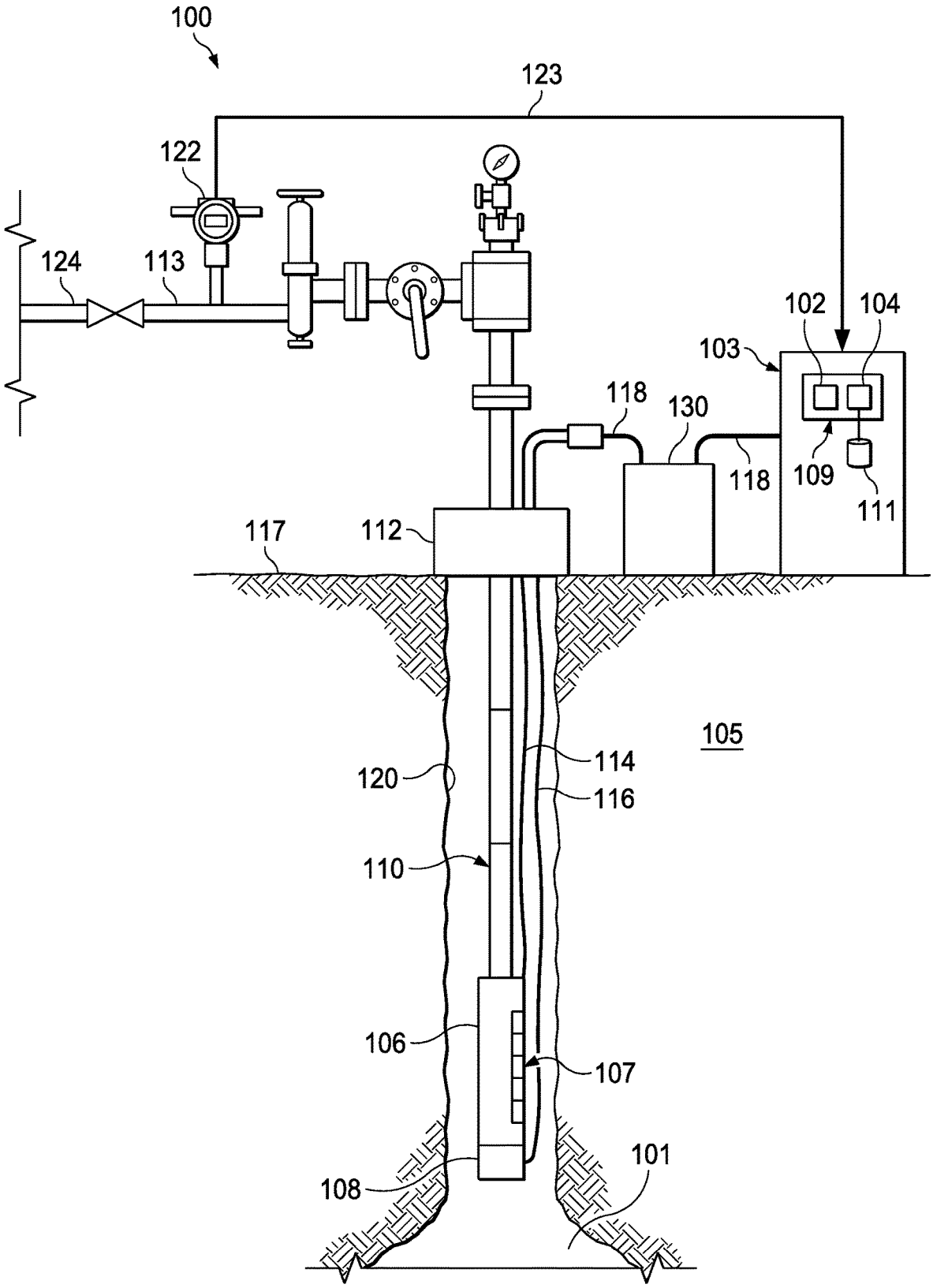
FIG. 1 is a cross-sectional, front schematic view of an over pressurization prevention system implemented to prevent over pressurization of a downstream piping network.

Implementation of the present disclosure include using a variable frequency drive (VFD) as a safety logic controller or in tandem with a safety logic controller as a pressurization prevention system to prevent or eliminate an over pressurization scenario of a piping network (for example, a downstream piping network). The system can be implemented in onshore oil producing well applications and offshore oil well producing applications, or any other application (for example, water systems) where the use of ESP is implemented as artificial lift. Some piping networks rely on high integrity pressure protection systems (HIPPS) to prevent over pressure scenarios when the ESPs are capable of over pressuring the piping network under a blocked outlet condition (for example, an ESP shut-in due to blockage condition in the downstream piping network). Designing, deploying, and operating HIPPS systems or other safety instrumented systems can be costly and time-consuming. Using a VFD with or as a safety logic solver (for example, as a certified system for use in safety applications as an additional design feature of VFDs currently found) can replace the need of stand-alone HIPPS systems or other costly equipment to prevent over pressurization scenarios of the downstream systems. To prevent over pressurization, the VFD can use a safety logic solver system. Upon predicting an over pressurization scenario, the VFD can reduce the ESP curve frequency or stop the lifting of fluid by the ESP so that the wellhead pressure produced by the ESP, at the downstream piping network, does not reach or exceed the maximum allowable operating pressure (MAOP) of the downstream piping network.

Implementations of the present disclosure may realize one or more of the following advantages. Using a VFD as a safety integrity system can save considerable resources by leveraging the existing ESP sensors in conventional applications and inexpensive VFD equipment. Additionally, in applications where multiple ESPs are used in multiple producing wellheads (either offshore or onshore), the over pressurization prevention system can allow increasing the lifting capacity of the ESPs by adding more pump stages (therefore incrementing the dead head pressure of the ESP). This can be done without the need of replacing the underrated piping due to the increase of the resulting ESP dead head pressure, for example in topside piping on existing offshore platforms (or piping systems on existing onshore fields) with a fixed MAOP on the surface equipment. Therefore, the strength of the piping network (in the upstream network or the downstream network) does not become a limitation when selecting a capacity of the ESPs, with increased quantity of pump stages increasing the lifting capacity of the system. Additionally, the VFD design disclosed in this document offers a foot print advantage for offshore oil platforms applications utilizing ESPs as artificial lift method, due to the elimination of space utilization by HIPPS systems (for example, bulky solid state logic solvers). This is advantageous because space and weight limitations are often matters of concern for offshore topside architectural and structural designs. Additionally, the present system can offer overpressure protection to the topside of offshore platforms without needing major work such as replacement of topsides piping of offshore platforms.

FIG. 1 illustrates an over pressurization prevention system 100 implemented in a wellbore 120. The system 100 includes an ESP 106 disposed at a downhole location within a wellbore 120 formed in a geologic formation 105. The geologic formation 105 includes a hydrocarbon reservoir 101 from which hydrocarbons can be extracted. Although the over pressurization prevention system 100 is shown implemented in an onshore wellhead setting, the system 100 can be used in one or more offshore wellhead settings or in other ESP applications where over pressurization can occur, such as in oil and gas refineries and chemical plants, or other applications with VFD where an ESP flows fluids (for example, in produced water injection systems) that can expose the piping network to over pressurization scenarios.

The ESP 106 features an electric motor 108 and multiple sensors 107 (for example, sensors connected to a monitoring control system of the ESP) configured to sense input and output operating parameters of the ESP 106. The system 100 also includes a communication line 114 and a wellhead 112 at a surface 117 of the wellbore 120. The communication line 114 connects the multiple sensors 107 to the wellhead 112 (for example, a receiver of the wellhead). The wellhead 112 is communicatively coupled, through a communication line 118 at the surface 117 of the wellbore 120, to a variable frequency drive (VFD) 102. The communication line 118 can include an electrical junction box 130 between the VFD 102 and the wellhead 112 to provide a safety barrier. The VFD 102 can be near the wellhead 112, at the wellhead 112, or at a different location at the surface 117 of the wellbore 120. The communication line 114 can transfer information and signals from the sensors 107 to the VFD 102 and transfer information back from the VFD 102 to the ESP 106 (for example, to the motor 108 of the ESP 106). In some implementations, the communication line 114 can be used to transmit information to the VFD 102 and a second communication line 116 connected to the ESP motor 108 can be used to send information from the VFD 102 to the motor 108.

The ESP 106 is fluidically coupled to downhole tubing or piping 110 disposed in the wellbore 120. The downhole tubing 110 flows fluid (for example, hydrocarbons) received from the ESP 106 to the surface 117 of the wellbore 120. Piping 113 originated from the wellhead piping can be over pressurized when the ESP 106 continues to flow fluid into the piping 113 in a blocked-outlet condition and above the MAOP of the piping 113. The piping 113 can be fluidically connected to or include a downstream piping network 124 (for example, downstream subsea or surface pipelines). In some implementations, a location downstream of the piping 113 and into the piping network 124 can also be over pressurized by the ESP 106. The piping network 124 has pipes and equipment that can include one or more of a trunkline, a flowline, a subsea flowline, an offshore platform topside piping or equipment, or any combination of them. The MAOP of one or both of the piping 113 or piping network 124 can be the MAOP of a weakest element of the respective equipment or the weakest mechanical link of the piping networks. The MAOP can be provided by the manufacturer of the piping or equipment, or calculated based on process characteristics and mechanical features of the equipment.

The VFD controller 102 can be inside a VFD cabinet 103 or enclosure (for example, a VFD control panel) that protects the VFD 102 and other electronics. The VFD cabinet 103 can also include a safety logic controller 104 (for example, a safety programmable or solid state logic controller) communicatively coupled to the VFD controller 102. In some implementations, the VFD controller 102 can include built-in safety logic solver hardware and software instead of being connected to a separate safety logic controller 104. In some implementations, the VFD cabinet 103 can include a safety certified processor 109 (for example, a computer processor) that includes or is connected to the VFD controller 102 and the safety logic solver 104. The safety processor 109 can be communicatively coupled to a computer-readable medium 111 (for example, a non-transitory computer-readable medium) that stores instructions. In some implementations, the computer-readable medium 111 can be connected to or be part of the safety logic controller 104. To use the VFD controller 102 with or as a safety logic controller, the VFD controller 102 is configured to comply with rigorous industry standards (for example, applying prior used concept to the VFD controller 102) to work as safety logic solver or as part of a safety instrumented system. The processor 109 can execute a safety logic function for over pressurization protection of the downstream piping network and/or an ESP control logic for pump control and downhole equipment protection. The processor 109 to execute the control and safety logic can be enclosed in the VFD controller 102 as single processor for both control and safety logic or as multiple processors for control and safety logic independently.

Additionally, the VFD cabinet 103 can have controllers for the VFD controller 102 and controllers for the safety logic controller 104. For example, an off-the-shelf safety logic controller 104 can be integrated into the VFD cabinet 103. The safety logic controller 104 can be responsible for the safety actions, as explained in detail later with respect to FIG. 2. The VFD cabinet 103 can thus have ESP controllers 102 for ESP control purposes and at the same time safety controllers 104 offering mechanical integrity protection of surface/subsea/topside and downstream equipment, all integrated into the VFD cabinet 103.

In some implementations, instead of using a separate VFD controller 102, an off-the-shelf safety logic controller 104 configured to be used in safety applications can also be used as a VFD controller. The safety logic controller 104 can be configured to provide the ESP control functions of the VFD controller 102 and the safety performance requirements inherent to safety logic controllers for mechanical integrity protection of surface/subsea/topside and downstream equipment.

The safety logic controller 104 or logic solver can receive the one or more signals from the one or more sensors 107 of the ESP, make appropriate decisions based on the nature of the signals, and change its outputs according to user-defined logic. The safety logic controller 104 may include programmable or non-programmable electronic equipment, such as relays, trip amplifiers, or programmable logic controllers.

The system 100 can also include a pressure sensor 122 attached to a pipe of the piping 113 near or at the surface 117 of the wellbore 120 (for example, near the wellhead 112). The surface pipe of the piping 113 is fluidically coupled to the downhole piping 110 and also fluidically coupled to the downstream piping network 124. The pressure sensor 122 is communicatively coupled, through a communication line 123, to the VFD controller 102 (or to the safety controller 104) when equipped with built-in safety functions. In some implementations, the pressure sensor 122 can wirelessly communicate with the VFD safety controller 102.

To prevent the piping 113 and/or the downstream piping network 124 from over pressurizing, the system 100 continuously gathers real time data from the multiple sensors 107 of the ESP to predict or detect an over-pressurization scenario at the piping 113 and piping network 124. By "real time," it is meant that a duration between receiving an input and processing the input to provide an output can be minimal, for example, in the order of seconds, milliseconds, microseconds, or nanoseconds, sufficiently fast to avoid the over-pressurization from occurring.

Specifically, to prevent over-pressurization scenarios of the piping 113 (for example, immediate piping fluidically coupled to the Christmas tree at the wellhead 112) or the downstream piping network 124, the processor 109 (or the VFD 102, or the safety logic controller 104, or a combination of both as the case may be) continuously receives, from the multiple sensors 107, multiple values representing actual output operating parameters of the ESP 106, which are collected and processed in real time. The values can include, without limitations, a temperature of the ESP motor 108, revolutions per minute (RPM) of the ESP shaft, horse power (HP) consumption of the ESP, a measurement of the output electrical current of the ESP, downhole pressure sensors and a flow rate of the ESP. The flow rate can be the output flow rate of the ESP 106 and the current consumption can be correlated to the ESP efficiency. For example, when pumping against a deadhead condition, the current consumption of the ESP 106 varies with the demand, and the Horse Power (HP) decreases in concordance with the ESP 106 performance curves.

Upon receiving the multiple values or inputs from the sensors 107, the processor 109 (or any other safety controller configuration in the VFD cabinet 103) selects a predetermined number of parameters from the multiple values, which are to be compared to respective predefined operating parameter thresholds. For example, the safety logic controller can use an M-out-of-N (MooN) voting architecture (for example, a 1oo1, 1oo2, a 2oo3, a 2oo4, or a 3oo6 voting architecture) based on a hardware fault tolerance (HTF) dictated by the safety integrity level (SIL) of 1, 2, or 3. For example, because SIL 3 is prevalent in the process industry for overpressure protection safety instrumented systems, the safety logic controller can use the voting architecture based on SIL 3 with a HFT equal to or greater than one. In some implementations, the processor 109 can select all of the values to be compared to the operating parameter thresholds. SIL is used to measure the safety availability or reliability of a safety instrumented function (SIF). For example, SIL 1 can be less reliable than SIL 3. A MooN voting architecture of 2oo3 means that two out of three values are required to sense or predict over-pressure, when compared against their respective threshold (for example, a predetermined trip set point correlated to the downstream piping or piping network weakest MAOP, in order to execute the safety logic and proceed with the elimination or prevention of the overpressure condition, for example by stopping the ESP or reducing ESP frequency (Hz) to predetermined safe Hz value.

The processor 109 compares each value of the selected set of values to a corresponding or respective operating parameters threshold. Each operating parameter threshold is determined in correlation with and using as a reference the lesser MAOP of the piping 113 or the piping network 124. Among others, the multiple operating parameter thresholds include a rate of change of a temperature of the ESP motor, revolutions per minute (RPM) of the ESP based on equivalent expected RPM at MAOP conditions, a rate of change of the HP of the ESP based on the system conditions, a rate of change of current consumption of the ESP based on system conditions, and a rate of change of flow rate of the ESP based a on system conditions for example, normal operation vs. blocked ESP discharge. Each or some of the operating parameter thresholds can be calculated based on equivalent parameters expected at MAOP conditions.

Based on the results of comparing the operating parameters (sensed by the multiple sensors 107) of the ESP 106 to the respective thresholds, if the processor 109 determines that one or more values of the group of values meets or exceeds its respective threshold, based in the logic architecture, the safety logic controller 104 triggers a trip. Triggering a trip can include changing or controlling an input parameter of the ESP. For example, the safety logic controller 104 electronically coupled with the VFD controller 102 can reduce the frequency of the ESP to a safe predetermined value to prevent overpressure, and at the same time the safety logic solver 104 can generate a signal to cut the electric current of the ESP 106 based on determining that one or multiple values meet or exceed their respective threshold. Thus, the processor 109 can determine or predict and prevent a risk or a level of risk of over pressurization of the piping 113 and/or piping network 124 by comparing the values to a predetermined threshold (also referred to as trip set points). It is understood that the functions performed by the processor 109 can be performed by the VFD controller 102 and the safety logic controller 104 (for example, without the processor 109). For example, the steps of comparing the actual readings input/output values of the ESP 106 to the operating parameter thresholds can be done by the safety logic controller 104 and the controlling of the ESP 106 inputs/outputs can be done by the VFD 102. As explained earlier, a VFD controller having safety logic capabilities or a safety logic controller having VFD controlling capabilities can also perform the functions of the processor 109.

Figure 2:
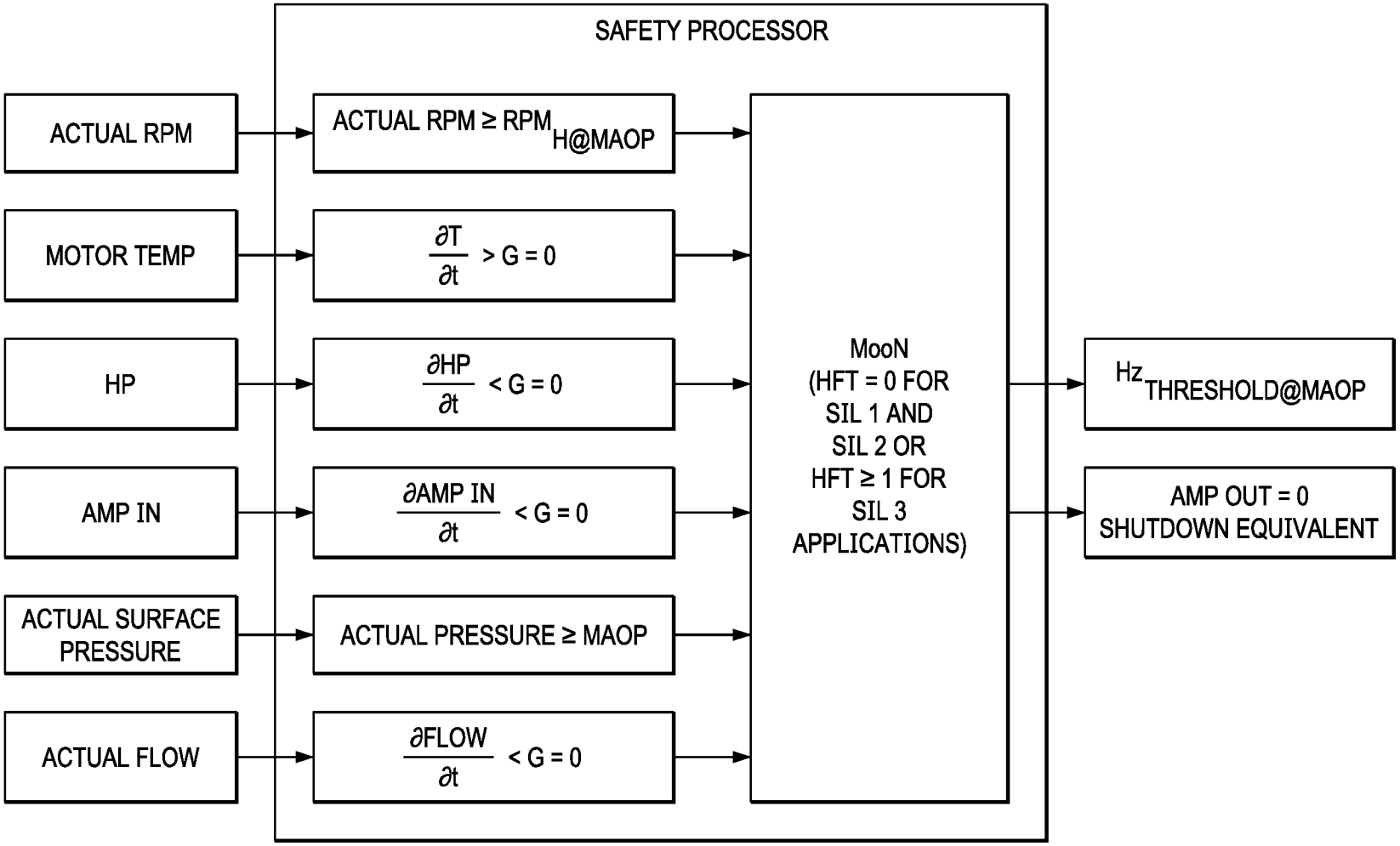
FIG. 2 is a block diagram of a pressurization prevention system used in the over pressurization prevention system for a downstream piping network.

Referring also to FIG. 2, because some of these thresholds are rates of change over time of a certain parameter, before comparing some of the values received from the ESP 106 to the thresholds, the processor 109 computes a rate of change over time of some of the operating parameters. For example, the processor 109 can compute a rate of change over time of temperature of the ESP motor, a rate of change over time of the HP consumption of the ESP 106, a rate of change over time of the current consumption of the ESP 106, and a rate of change over time of the ESP output flow rate. For example, the rate of change of motor temperature of the ESP 106 is compared to a threshold representing the rate of change of a temperature of the motor of the ESP 106 based on expected motor temperature at blocked outlet or shut-in conditions in comparison with the ESP temperature during normal flowing conditions (that is normal operating point). The rate of change of the HP is compared to a threshold representing the rate of change of the HP based on the system at blocked outlet conditions in comparison with the HP consumption of the ESP at normal operating point. The rate of change of the current consumption of the ESP 106 is compared to a threshold representing the rate of change of current consumption of the ESP 106 equivalent to current consumption at blocked outlet conditions in comparison with the current consumption at normal operating point, and the rate of change of the flow rate of the ESP 106 is compared to a threshold representing the rate of change of flow rate of the ESP 106 equivalent to a flow reduction representing a blocked flow. The thresholds that represent rates of change over time can be percentage measured variables (greater or lesser than zero) and depend on pump characteristics and performance.

The RPM of the ESP 106 can be compared to a threshold that is not a rate of change over time. For example, the RPM of the ESP 106 can be compared to an RPM threshold calculated using affinity laws. For example, because the rate of change of pressure is the quadratic of the rate of change of RPM (which becomes a predictive parameter forecasting a potential overpressure scenario in the downstream systems), the RPM threshold based on the MAOP can be calculated using the following equations:

$$RPM_{H@MAOP} = \sqrt[2]{\frac{MAOP_{Downstream}}{P_{MAX(@60\ Hz)}}} * 3500$$

$$\frac{RPM_{H@MAOP}}{3500} = \frac{\text{Hz}}{60}$$

where $MAOP_{Downstream}$ is the MAOP of the weakest component (piping or equipment) in the downstream network and $P_{MAX(@60\ HZ)}$ is the pressure (DHP) of the pump at operating conditions (for example, 60 Hz). As the frequency of the pump at operating condition (60 Hz) is known, then the RPM at operating conditions is also known (3500 RPM). With these parameters, the threshold $RPM_{H@}$ MAOP conditions can be then calculated. The ESP head values sourced from the pump curves (equivalent pressure) at pump discharge, can be corrected based on the liquid column above the ESP, otherwise the MAOP at surface would not be comparable with the pressure information extracted from the pump curves.

Referring back to FIG. 1, in some implementations, the processor 109 also uses a value (for example, a third value) received from the pressure sensor 122 to determine if there is a risk of over pressurization in the piping 113 or downstream piping network 124. For example, the value received from the pressure sensor can represent a fluidic pressure of a surface piping system. The third value can be compared with a pressure threshold that represents the actual MAOP of the piping 113 or downstream piping network 124. As shown in FIG. 2, the processor 109 can use the ESP sensor values or a set of values from a combination of the ESP values and the pressure sensor value (received from sensor 122) to determine an over-pressurization risk. In some implementations, the processor 109 can use all of the values received from the ESP sensors 107 and the pressure sensor 122 to make decisions, such as stopping the ESP 106 by either cutting the power to the ESP or reducing the VFD controller 102 frequency to a safe threshold that would not exceed the MAOP of the downstream piping system.

FIG. 2 illustrates a block diagram of an over-pressurization prevention system used for the safety of downstream piping network. The safety processor receives the readings form the ESP sensors (see FIG. 1) and compares those values to respective thresholds. For example, the processor can compare the actual RPMs of the ESP to an expected RPM value of the ESP correlated to the MAOP of the piping network when in blocked outlet conditions. The processor can also determine, as an example, if a rate of change over time of the temperature, HP, electrical current, and output flow rate of the ESP is less than, equal to, or greater than zero. The processor can also compare the actual pressure of the piping network to the MAOP of the piping network. As further described in detail later with respect to FIG. 4, the processor determines if the parameters of the ESP reach their respective thresholds and then uses a MooN voting architecture to decide if the current or frequency of the ESP should be changed.

After the operating parameters of the ESP have been compared to their respective thresholds, the determination of whether or not to reduce or cut an input of the ESP is made. For example, the electric current feeding the ESP can be cut or the VFD frequency reduced (which forces the VFD controller to lower output hertz). The determination is made based on a MooN voting architecture of, for example, the safety logic controller 104. The safety logic controller can use, for example, a 1oo2 voting architecture with an HFT equal to or greater than 1 and with a safety integrity level 3 (SIL 3).

Figure 3:
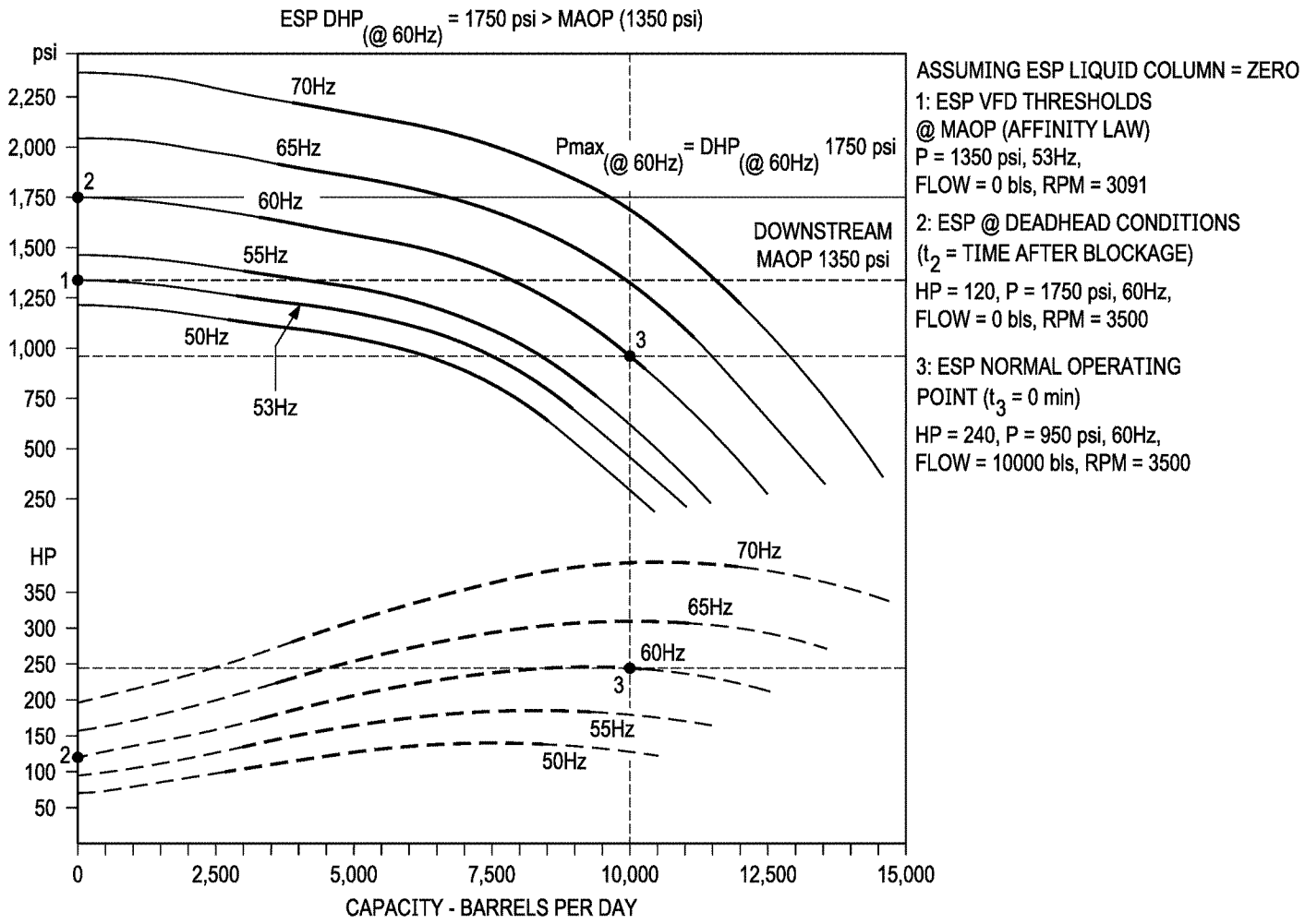
FIG. 3 is an example ESP curve showing pressure vs flow rate and horse power vs flow rate used in the over pressurization prevention system.

FIG. 3 is an example ESP curve showing the discharge pressure (for example, in pounds per square inch) of the ESP without taking into account the liquid head vs flow rate of the ESP (for example, in barrels per day), and the HP of the motor of the ESP vs flow rate of the ESP. Points 3 along the respective 60 Hz curves represent parameters of the ESP at which the ESP operates under normal conditions, without over pressurizing the piping network. For example, referring to point 3 in the pressure vs flow rate curve at 60 Hz, the ESP operates at about 240 HP, at a pressure of about 950 psi, at a flow rate of about 10,000 barrels per day, and at 3,500 RPMs. Point 2 in the pressure vs flow rate curve represents a deadhead pressure of the ESP and point 2 in the HP vs flow rate curve represents the HP of the ESP at deadhead pressure. For example, the maximum pressure (the dead head pressure) that the ESP can produce is 1750 psi, operating at 120 HP, operating at 3500 RPMs, and operating at a flow rate of zero barrels per day, and assuming a liquid head of zero at the ESP discharge. Point 1 represents a pressure of the ESP that is equivalent to the MAOP of the weakest link in the piping network. For example, if the MAOP of the piping network is 1350 psi, then point 1 represents a fluidic pressure of the ESP of 1350 psi, operating at 3091 RPMs, and operating at a flow rate of zero barrels per day, and assuming a liquid head of zero at the ESP discharge. The pressurization prevention system explained earlier with respect to FIGS. 1 and 2 changes frequency of the ESP or cut the current, based on a possibility of the fluidic pressure in the piping network reaching the MAOP, to prevent the ESP from over pressurizing the piping network. Thus, the ESP curves at different operating frequencies in FIG. 3 can be used to determine expected ESP parameters during a blocked outlet condition of the piping network. If the dead head pressure of the ESP is greater than the MAOP of the piping network, (as shown in FIG. 3) the ESP has the capacity of over pressurizing the piping network. The over pressurization prevention system prevents the ESP from increasing the pressure of the piping network above the MAOP.

Figure 4:
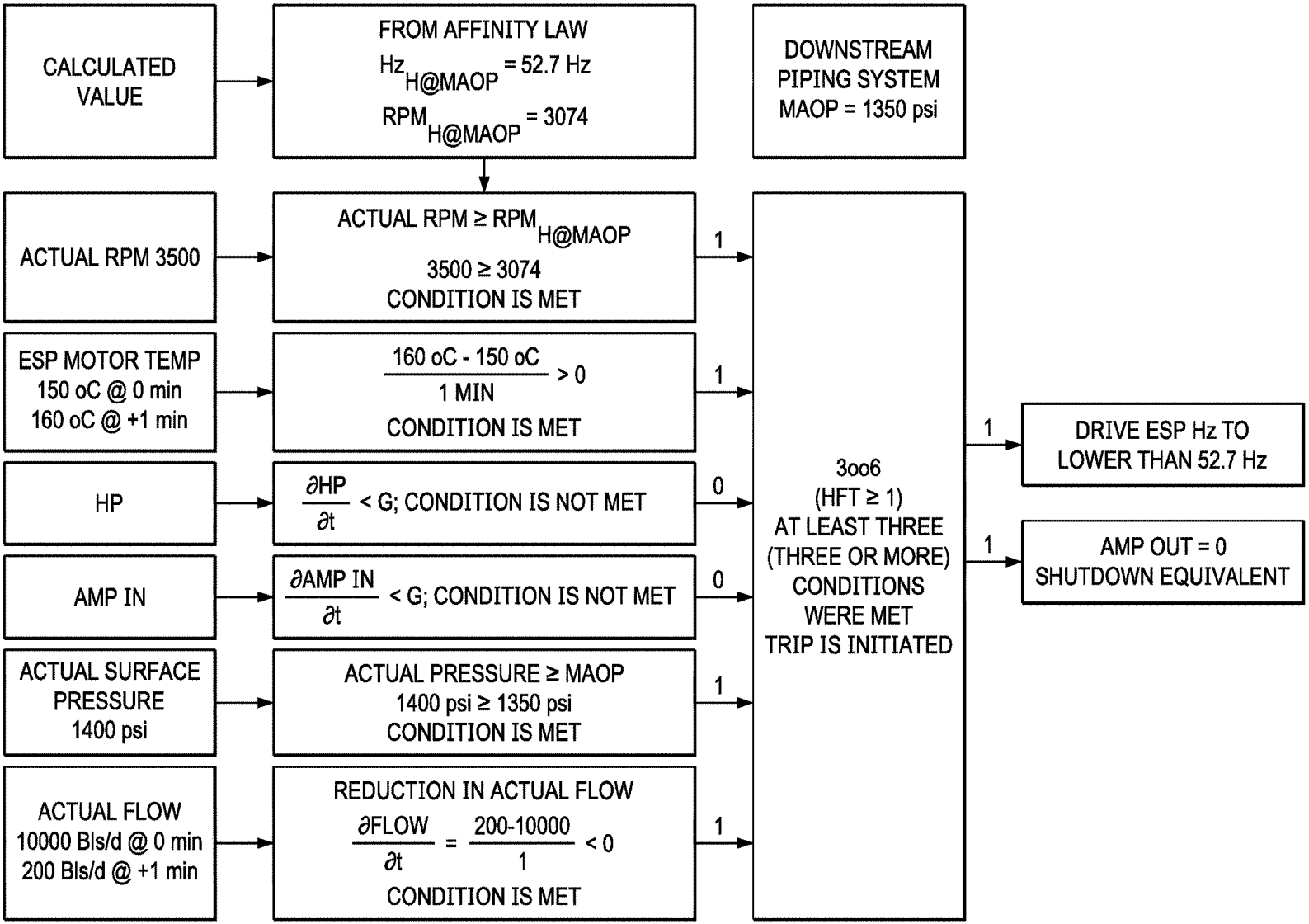
FIG. 4 is a block diagram of an example process of the pressurization prevention system.

FIG. 4 is an example process of the pressurization prevention system in which the system determines that there is a risk of over pressurization of the piping network. For example, for an MAOP of the piping network of 1350 psi, the processor can use predetermined thresholds for each ESP parameter that are indicative of a fluidic pressure that has a potential of exceeding the MAOP. For example, each predetermined threshold can indicate or be intrinsically correlated to a fluidic pressure at the piping downstream network that is close to, equal to, or greater than the MAOP. For an MAOP of 1350 psi, the RPMs threshold of the ESP can be 3074 RPMs, the temperature threshold of the ESP can be a rate of change in temperature over time that is greater than zero when in blocked outlet condition, the HP threshold of the ESP can be a rate of change in HP over time that is equal to or less than 'G' (where 'G' is a value dependent on ESP characteristics and performance), the current threshold of the ESP can be a rate of change in current over time that is equal to or less than 'G', and the flow rate threshold can be a rate of change in flow rate over time that is less than zero. In the example depicted in FIG. 4, because the processor uses a 3oo6 voting architecture, a trip is initiated because the processor determines that at least three out of six parameters meet their thresholds. For example, the processor determines that the RPMs at which the pump is operating (3500 RPMs) is greater than 3074 RPMs, that the rate of change in temperature of the ESP is greater than zero, that the actual pressure of the piping network (1400 psi) is greater than 1350 psi, and that the rate of change of the flow rate of the ESP is negative or less than zero. Upon determining that three (or more) out of six conditions are met, the processor initiates a trip to change the current and/or frequency of the ESP.

Figure 5:
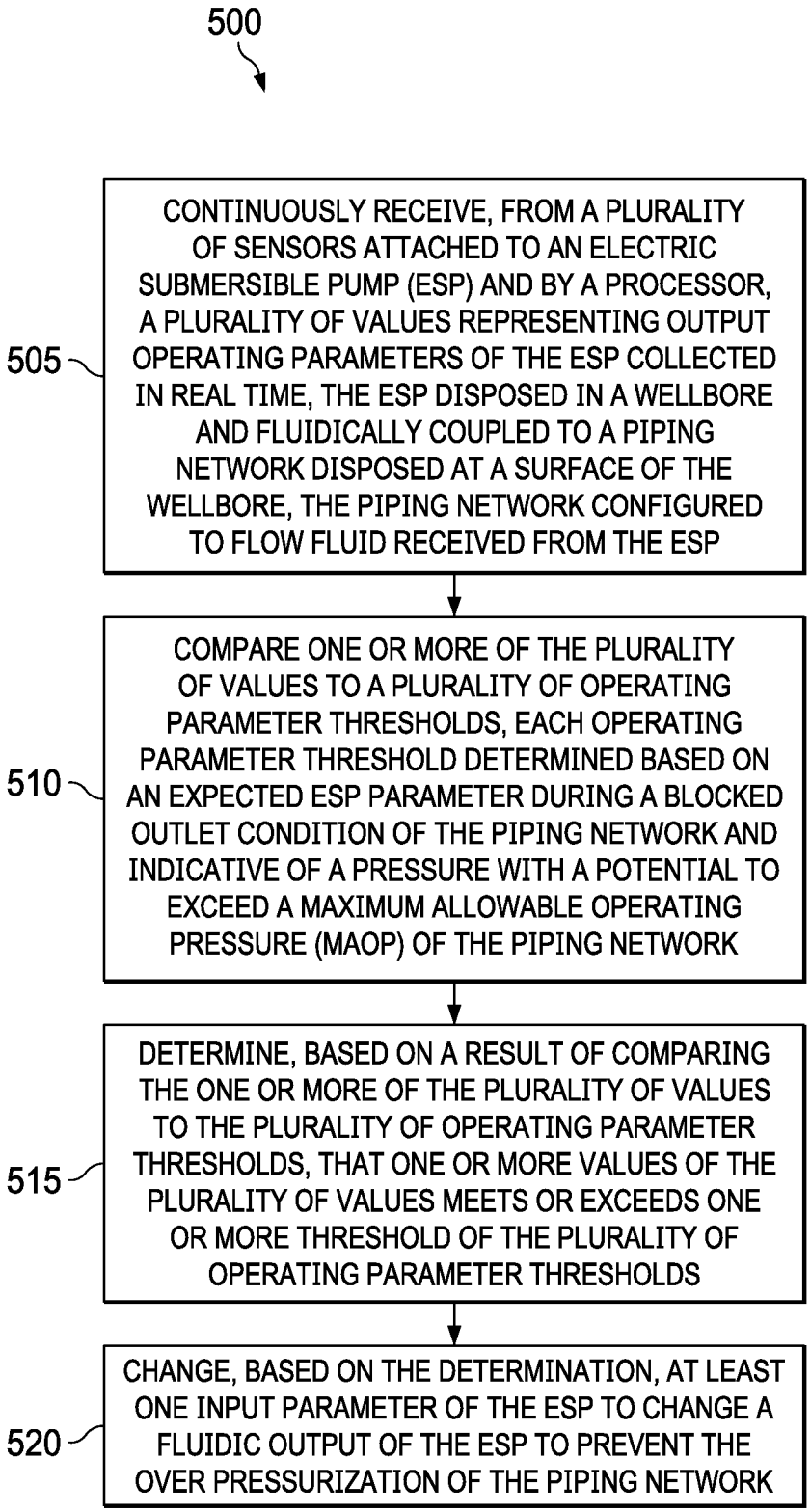
FIG. 5 is a flow chart of an example method of preventing over pressurization of a downstream piping network.

FIG. 5 shows a flow chart of an example method 500 of preventing over pressurization of the piping network. The method includes continuously receiving, from multiple sensors attached to an electric submersible pump (ESP) and by a processor, multiple values representing output operating parameters of the ESP collected over time, the ESP disposed in a wellbore and fluidically coupled to a piping network disposed at a surface of the wellbore, the piping network configured to flow fluid received from the ESP (505). The method also includes comparing, by the processor, one or more of the multiple values to multiple operating parameter thresholds, each operating parameter threshold determined based on an expected ESP parameter during a blocked outlet condition of the piping network and indicative of a pressure with a potential to exceed a maximum allowable operating pressure (MAOP) of the weakest component of a downstream piping network (510). The process also includes determining, by the processor and based on a result of comparing the one or more of the multiple values to the multiple operating parameter thresholds, that one or more values of the multiple values meets or exceeds one or more threshold of the multiple operating parameter thresholds (515), and based on the determination, changing, by the processor, at least one input parameter of the ESP to change a fluidic output of the ESP to prevent the over pressurization of the piping network (520).

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

That which is claimed is:

1. A method comprising:

continuously receiving, from a plurality of sensors attached to an electric submersible pump (ESP) and by a processor, a plurality of values representing output operating parameters of the ESP collected over time, the ESP disposed in a wellbore and fluidically coupled to a piping network disposed at a surface of the wellb ore, the piping network configured to flow fluid received from the ESP, wherein the plurality of values comprises one or more of a temperature of the ESP motor, revolutions per minute (RPM) of the ESP, horse power (HP) of the ESP, a current of the ESP, and a flow rate output of the ESP;

comparing, by the processor, one or more of the plurality of values to a respective operating parameter threshold of a plurality of operating parameter thresholds, each of the plurality of operating parameter thresholds determined based on at least one of 1) an expected ESP parameter during a blocked outlet condition of the piping network or 2) an association of the operating parameter threshold with a fluidic pressure of the piping network that has a potential of reaching a maximum allowable operating pressure (MAOP) of the piping network, wherein the operating parameter thresholds comprise one or more of a rate of change of a temperature of the ESP expected during the blocked outlet condition, revolutions per minute of the ESP required to produce a pressure equivalent to the MAOP, a rate of change of the HP of the ESP expected during the blocked outlet condition, a rate of change of current of the ESP expected during the blocked outlet condition, and an expected rate of change of flow rate output from the ESP during a blocked outlet condition;

determining, by the processor and based on a result of comparing the one or more of the plurality of values to the plurality of operating parameter thresholds, that at least one of the plurality of values is equal to or exceeds the respective operating parameter thresholds; and based on the determination, changing, by the processor, at least one input parameter of the ESP to change a fluidic output of the ESP to prevent the over pressurization of the piping network.

2. The method of claim 1, further comprising, prior to comparing the one or more of the plurality of values to the plurality of operating parameter thresholds, determining, by the processor, a first value representing a rate of change over time of an output operating parameter of the output operating parameters of the ESP, wherein at least one of the plurality of operating parameter thresholds comprises a rate of change threshold representing a rate of change over time of the respective operating parameter that is indicative of a pressure with a potential to exceed the MAOP of the piping network, and wherein comparing the one or more of the plurality of values to the plurality of operating parameter thresholds comprises comparing the first value to the rate of change threshold.

3. The method of claim 1, wherein the processor comprises a safety logic controller communicatively coupled to a variable frequency drive (VFD) controller, and wherein comparing the one or more of the plurality of values to the plurality of operating parameter thresholds comprises comparing the one or more of the plurality of values to the plurality of operating parameter thresholds by the safety logic controller and wherein changing the at least one input parameter of the ESP comprises lowering an ESP operating frequency or cutting current of the ESP by the VFD controller.

4. The method of claim 3, further comprising, prior to comparing the one or more of the plurality of values to the plurality of operating parameter thresholds, determining, by the processor using a MooN voting architecture and based on a hardware fault tolerance (HTF) equal to or greater than 0 and with a safety integrity level of between 1 and 3 (SIL 1-SIL 3), a number of values from the plurality of values to be compared to the plurality of operating parameter thresholds, and wherein comparing the one or more of the plurality of values to the plurality of operating parameter thresholds comprises comparing the number of values from the plurality of values to the plurality of operating parameter thresholds.

5. The method of claim 3, wherein determining that the one or more values meets or exceeds the one or more thresholds comprises using a MooN voting architecture with an HFT determined for a safety integrity level of between 1 and 3 (SIL 1-SIL 3).

6. The method of claim 1, wherein continuously receiving the plurality of values comprises receiving the plurality of values measured in real-time.

7. The method of claim 1, wherein changing the at least one input parameter of the ESP comprises reducing at least one of an input operating frequency of the ESP and an input current of the ESP based on predetermined voting criteria.

8. The method of claim 1, further comprising:

receiving, by the processor, a pressure value from a pressure sensor disposed at a surface pipe of the piping network, the pressure value representing a fluidic pressure of the surface pipe or the piping network; and comparing, by the processor, the pressure value to the actual MAOP of the piping network;

wherein determining that the one or more values meets or exceeds the one or more thresholds comprises determining, based on the result of comparing the pressure value to the actual MAOP of the piping network and based on the result of comparing the one or more of the plurality of values to the plurality of operating parameter thresholds, a risk of over pressurization of the piping network.

9. The method of claim 1, wherein the piping network comprises equipment that includes at least one of a topside piping in offshore applications, surface piping in onshore applications, a trunkline, a flowline, a subsea flowline in offshore applications, or process equipment, and wherein the MAOP is the MAOP of a weakest element of the respective equipment or the weakest mechanical link of the piping network.

10. An over-pressurization prevention system comprising:

a processor; and a non-transitory computer-readable medium communicatively coupled to the processor, the medium storing instruction which, when executed, cause the processor to perform operations comprising:

continuously receiving, from a plurality of sensors attached to an electric submersible pump (ESP), a plurality of values representing output operating parameters of the ESP collected over time, the ESP disposed in a wellbore and fluidically coupled to a piping network disposed at a surface of the wellbore, the piping network configured to flow fluid received from the ESP, the plurality of values comprising one or more of a temperature of the ESP motor, revolutions per minute (RPM) of the ESP, horse power (HP) of the ESP, a current of the ESP, and a flow rate output of the ESP;

comparing one or more of the plurality of values to a respective operating parameter threshold of plurality of operating parameter thresholds, each of the plurality of operating parameter thresholds determined based on at least one of 1) an expected ESP parameter during a blocked outlet condition of the piping network or 2) an association of the operating parameter threshold with a fluidic pressure of the piping network that has a potential of reaching a maximum allowable operating pressure (MAOP) of the piping network, wherein the operating parameter thresholds comprise one or more of a rate of change of a temperature of the ESP expected during the blocked outlet condition, revolutions per minute of the ESP required to produce a pressure equivalent to the MAOP, a rate of change of the HP of the ESP expected during the blocked outlet condition, a rate of change of current of the ESP expected during the blocked outlet condition, and an expected rate of change of flow rate output from the ESP during a blocked outlet condition;

determining, based on a result of comparing the one or more of the plurality of values to the plurality of operating parameter thresholds, that at least one of the plurality of values is equal to or exceeds the respective operating parameter threshold; and based on the determination, changing at least one input parameter of the ESP to change a fluidic output of the ESP to prevent the over pressurization of the piping network.

11. The system of claim 10, wherein the operations further comprise, prior to comparing the one or more of the plurality of values to the plurality of operating parameter thresholds, determining a first value representing a rate of change over time of an output operating parameter of the output operating parameters of the ESP, wherein at least one of the plurality of operating parameter thresholds comprises a rate of change threshold representing a rate of change over time of the respective operating parameter that is indicative of a pressure with a potential to exceed the MAOP of the piping network, and wherein comparing the one or more of the plurality of values to the plurality of operating parameter thresholds comprises comparing the first value to the rate of change threshold.

12. The system of claim 10, wherein the processor comprises a safety logic controller communicatively coupled to a variable frequency drive (VFD) controller, and wherein comparing the one or more of the plurality of values to the plurality of operating parameter thresholds comprises comparing the one or more of the plurality of values to the plurality of operating parameter thresholds by the safety logic controller and wherein changing the at least one input parameter of the ESP comprises lowering a ESP operating frequency or cutting current of the ESP by the VFD controller.

13. The system of claim 12, wherein the operations further comprise, prior to comparing the one or more of the plurality of values to the plurality of operating parameter thresholds, determining, using a MooN voting architecture and based on a hardware fault tolerance (HTF) determined for a safety integrity level of between 1 and 3 (SIL 1-SIL 3), a number of values from the plurality of values to be compared to the plurality of operating parameter thresholds, and wherein comparing the one or more of the plurality of values to the plurality of operating parameter thresholds comprises determining the number of values from the plurality of values to the plurality of operating parameter thresholds.

14. The system of claim 12, wherein determining the first value comprises using a MooN voting architecture with an HFT determined for a safety integrity level of between 1 and 3 (SIL 1-SIL 3).

15. The system of claim 10, wherein the processor comprises one or more of 1) a VFD controller with built-in safety logic solver hardware, 2) a processor communicatively coupled to a VFD controller, 3) a processor communicatively coupled to a safety logic controller, or 4) a processor communicatively coupled to a VFD controller and a safety logic controller.

16. The system of claim 10, wherein controlling the at least one input parameter of the ESP comprises reducing at least one of an input operating frequency of the ESP and an input current of the ESP based on predetermined voting criteria.

17. The system of claim 10, wherein the operations further comprise:

receiving a pressure value from a pressure sensor disposed at a surface pipe of the piping network, the pressure value representing a fluidic pressure of the surface pipe or the piping network; and comparing the pressure value to the actual MAOP of the piping network;

wherein determining that the one or more values meets or exceeds the one or more thresholds comprises determining, based on the result of comparing the pressure value to the actual MAOP of the piping network and based on the result of comparing the one or more of the plurality of values to the plurality of operating parameter thresholds, a risk of over pressurization of the piping network.

* * * * *